US008405695B2

(12) United States Patent
Yoshida

(10) Patent No.: US 8,405,695 B2
(45) Date of Patent: Mar. 26, 2013

(54) PRINTING APPARATUS

(75) Inventor: Naoki Yoshida, Tokorozawa (JP)

(73) Assignee: Wedg Co., Ltd., Tokyo (JP)

( * ) Notice: Subject to any disclaimer, the term of this patent is extended or adjusted under 35 U.S.C. 154(b) by 363 days.

(21) Appl. No.: 12/814,047

(22) Filed: Jun. 11, 2010

(65) Prior Publication Data

US 2011/0304680 A1 Dec. 15, 2011

(51) Int. Cl.
*B41J 2/325* (2006.01)

(52) U.S. Cl. ..... 347/173

(58) Field of Classification Search ..... 347/171, 347/172, 173; 400/120.01, 120.02
See application file for complete search history.

(56) References Cited

U.S. PATENT DOCUMENTS 4,540,992 A * 9/1985 Moteki et al. ..... 347/173
5,196,864 A * 3/1993 Caine ..... 347/171
5,724,085 A 3/1998 Inui et al.
6,908,239 B1 * 6/2005 Foster et al. ..... 400/120.02
7,515,163 B2 * 4/2009 Suzuki et al. ..... 347/173
2007/0122223 A1 5/2007 Suzuki et al.

FOREIGN PATENT DOCUMENTS

| | | |
|---|---|---|
| JP | 8-244262 | 9/1996 |
| JP | 2006-075996 | 3/2006 |
| JP | 2006-082248 | 3/2006 |
| JP | 2006-346983 | 12/2006 |
| JP | 2007-144728 | 6/2007 |

* cited by examiner

*Primary Examiner* — Huan Tran
(74) *Attorney, Agent, or Firm* — Brundidge & Stanger, P.C.

(57) ABSTRACT

Provided is a thermal transfer-system recording device which, by accurately conveying a medium between each of the thermal heads, eliminates image position displacement and image pitch variations between each of the thermal heads, thereby improving the overlay precision of each color and enabling printing on both sides of the medium. A pair of small pieces (300, 302) is provided between adjacent thermal heads and close to the conveying platen drum, and rollers (307, 308) are provided at both ends of the small pieces in the circumferential direction thereof. The rollers suppress separation of the recording paper from the platen drum by pressing the recording paper 100 against a flexible body 18A of the platen drum surface.

2 Claims, 7 Drawing Sheets

EXPERIMENTAL VALUES PERTAINING TO CLEARANCE BETWEEN BIASING MEMBERS AND DRUM SURFACE, AND PAPER FEED PRECISION

PRINTING APPARATUS

FIELD OF THE INVENTION

The present invention relates to an image recording device which transfers color material to a medium to form images.

BACKGROUND

The image recording device comprises a plurality of thermal heads and ink ribbons and overlays colors sequentially on the medium along a flow direction of the medium to form the final image. As such a recording device, the recording devices disclosed in Japanese Patent Laid-Open Publication Nos. H08-244262, 2006-82248, and 2006-75996 exist, for example.

These recording devices comprise, for each color, a thermal head and a platen roller which lies opposite the thermal head and possess a structure in which the thermal heads and platen rollers are arranged in a line in the conveyance direction of the medium and substantially linearly in that order. Furthermore, the recording device is configured comprising a pair of conveyance rollers at the tips of the thermal heads of each color such that the medium is conveyed between the pair of conveyance rollers which hold the medium from both sides, while supplying an ink ribbon to the thermal heads, pressing the thermal head against the platen roller, and thermally transferring ink to the medium which is fed between the thermal head and platen roller. The recording device transfers yellow, magenta and cyan while conveying the medium, and thus forms the intended color image on the medium.

SUMMARY

Conventional recording devices comprise a plurality of platen rollers and a plurality of conveyance rollers. An exact match in the precision of these rollers is very hard to achieve. For example, when the parallelism of the plurality of platen rollers differs from that of the conveyance rollers and the right angle which the medium forms relative to the conveyance direction is different in each case, the media are fed independently by the parts of the thermal heads of each color, and the position to which ink is actually transferred is displaced from the original position on the medium to which ink is transferred in each color, and hence there is a problem in that ink overlay precision suffers.

That is, in a conventional system, even when paper is accurately fed between the conveyance rollers, since there are at least a plurality of heads and a plurality of flexible-body platen rollers which rotate as a pair, when there is displacement in the parallelism of each of the platen rollers, the paper conveyance orientation changes, thereby generating a paper skew. For example, among the platens of each color, if there is a 0.1 mm displacement per 100 mm in the parallelism of the first and second platens, there is a 1/100 tilt, and consequently when the paper is conveyed by 100 mm, a paper skew of 0.1 mm is generated.

Furthermore, since, in addition to the standard conveyance rollers, there are flexible platen rollers in the paper conveyance path, the elastic deformation of the platen rollers has an adverse effect on conveyance and consequently at the point where the paper reaches the next head and platen, color cannot be overlaid in a predetermined position of the paper, and even when the conveyance roller feeds the paper accurately, since there are platens that are flexible bodies which similarly rotate with a conveyance effect in the paper conveyance path, it is extremely difficult to overlay each of the colors accurately.

Furthermore, since the medium is fed by a plurality of conveyance rollers, when there is a difference in the conveyance speed between the plurality of conveyance rollers, tension is applied to the medium, thereby generating stretching or bending of the medium or an error in the feed precision of the medium between the heads such as slippage between the medium and conveyance rollers.

Therefore, in conventional recording devices, grip rollers with protuberances have been employed as the conveyance rollers in order to improve the precision with which the medium is fed. This grip roller is a metal roller which has needle-like protuberances on the outer roller circumference and which abuts against the rear surface of the print, and is paired with a nip roller without needle-like protuberances such that the medium is pinched between the rollers, ensuring that slippage is not produced between the paper and rollers and securing precision when the medium is conveyed with the protuberances digging into the medium.

However, even though no slippage is generated, errors in the parallelism between the rollers and in the feeding of the conveyance drive system, as well as friction between one conveyance roller and another and between other conveyance members such as the platens causes stretching or slippage of the paper and consequently a large error in the medium feed precision. In addition, in a recording device of this type, undulations are formed in the printed rear surface of the medium by the conveyance rollers and therefore both sides of the medium cannot be printed, which is problematic.

An object of the present invention is therefore to provide a thermal transfer system image recording device which accurately conveys a medium between each of the thermal heads, thereby eliminating positional displacement of the image between each of the thermal heads and image pitch variations, thereby improving the precision with which each color is overlaid and enabling both sides of the medium to be printed.

In order to achieve this object, the present invention comprises a platen drum which comprises a flexible body on a circumferential surface thereof; first means for rotationally driving the platen drum; at least three thermal heads arranged sequentially along the circumferential surface of the platen drum; second means for supplying a medium to the platen drum; third means for supplying ink ribbon between each of the thermal heads and the medium; fourth means, provided close to the circumferential surface of the platen drum between the plurality of thermal heads, for biasing the medium toward the flexible body; and fifth means for controlling print cycle timings, for printing the medium, of each of the plurality of thermal heads, wherein the platen drum sequentially conveys the medium to the plurality of thermal heads in accordance with the rotation of the platen drum as a result of friction acting between the flexible body and the medium which is pressed by the plurality of thermal heads onto the flexible body.

According to the present invention, by tightly attaching the medium to the platen drum and conveying the medium to the plurality of thermal heads on the basis of a single platen drum, the medium can be accurately conveyed between the thermal heads and image position displacement and image pitch fluctuations can be eliminated between the thermal heads, thereby improving the overlay precision of each color and enabling printing of both sides of the medium.

DETAILED DESCRIPTION

Figure 1:
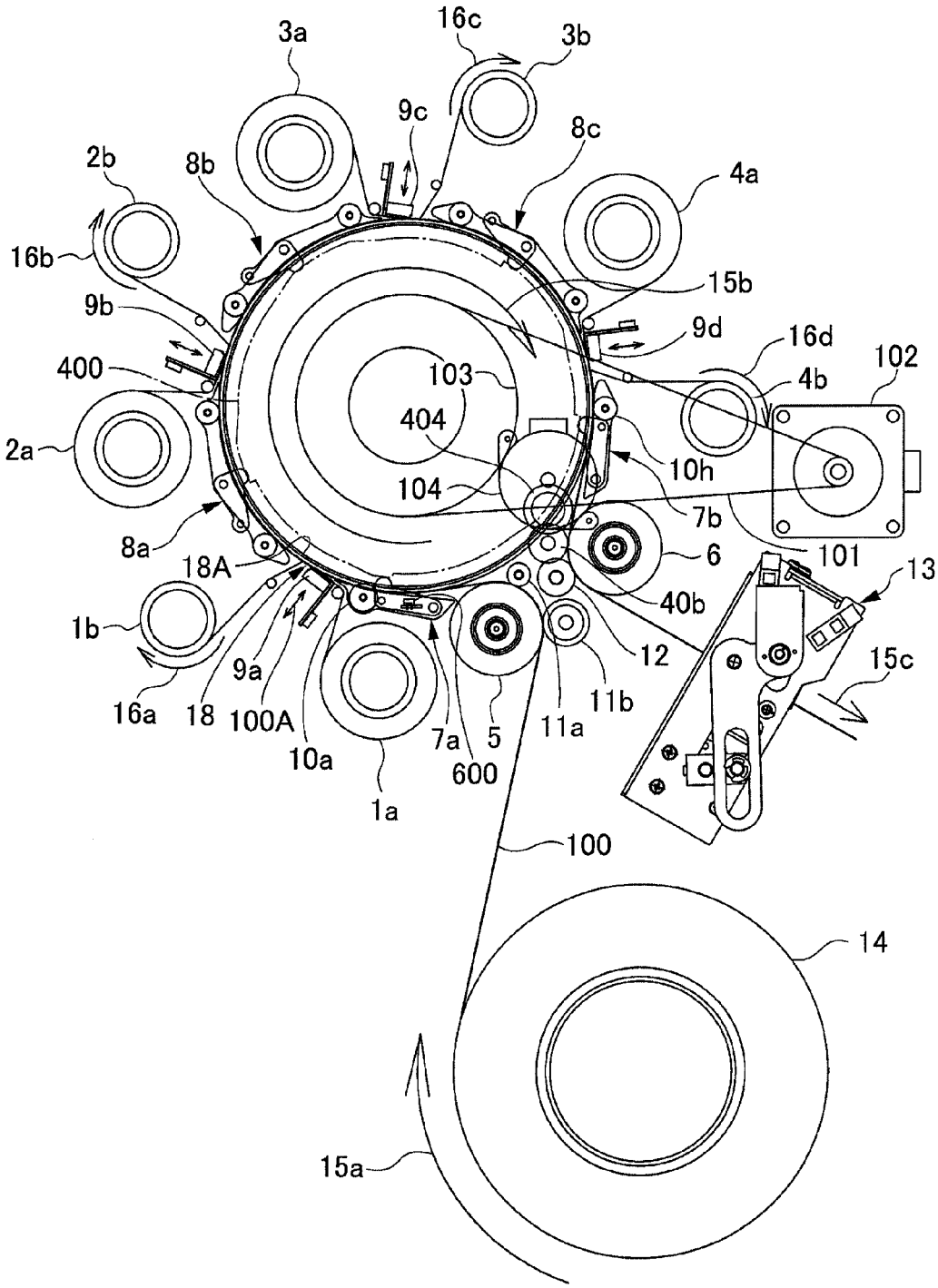
FIG. 1 is a side view of a thermal transfer recording device according to a first embodiment of the present invention which shows an overview of the arrangement of a plurality of elements which form part of the recording device.

An embodiment according to the present invention will be explained next with reference to the attached drawings. As shown in FIG. 1, the recording device broadly comprises a platen drum 18, a supply roller 14 which supplies recording paper 100, which is a medium, to the platen drum, a cutter 13 for sequentially cutting the recording paper, which is conveyed continuously while being printed, into postcard size pieces, for example, and a drive motor 102, around which a drive belt 101 is wound, for rotating the rotating the drive belt 101.

Figure 2:
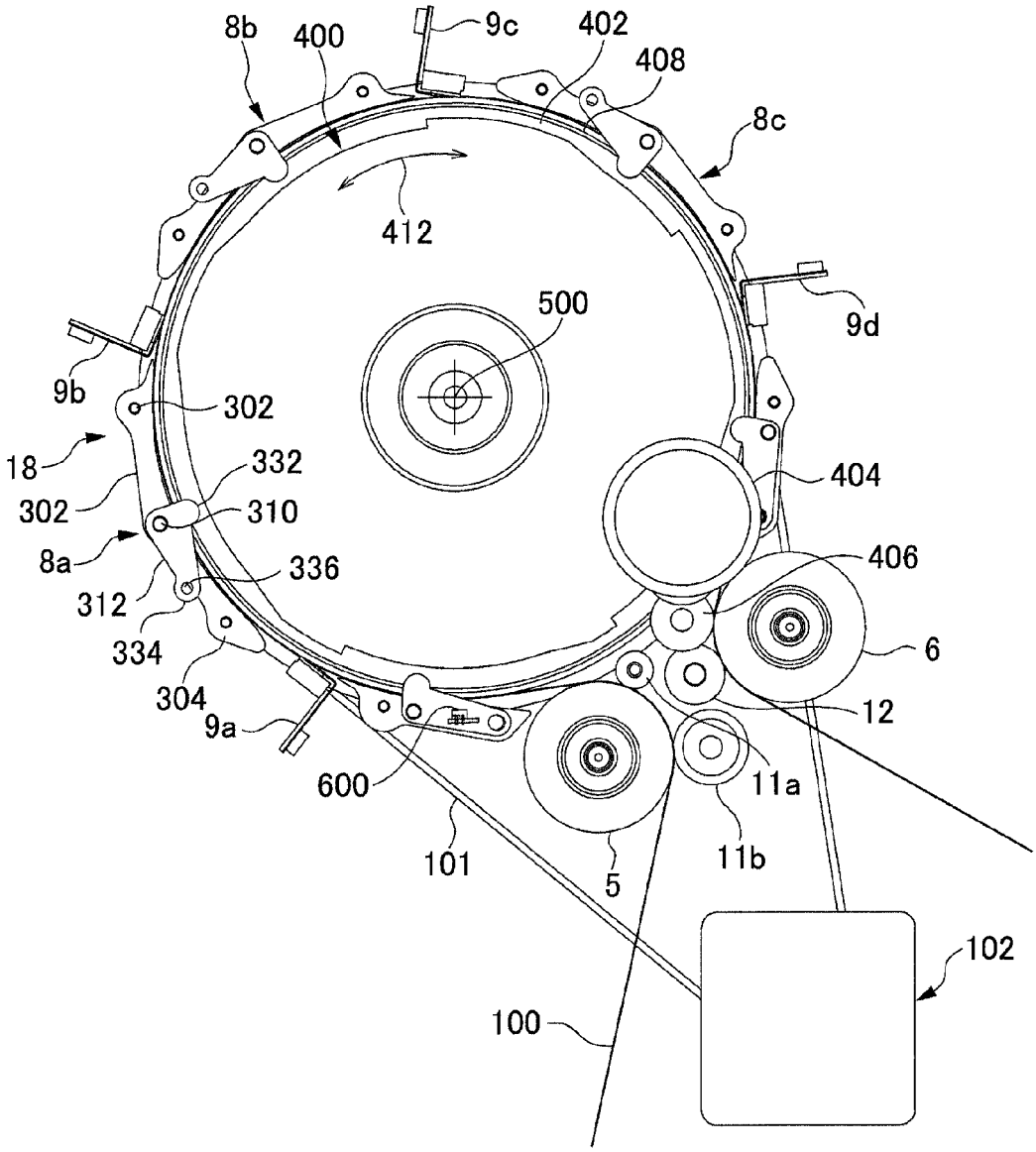
FIG. 2 is a side view of the recording device which shows the positional relationships of the biasing means in particular.
Figure 3:
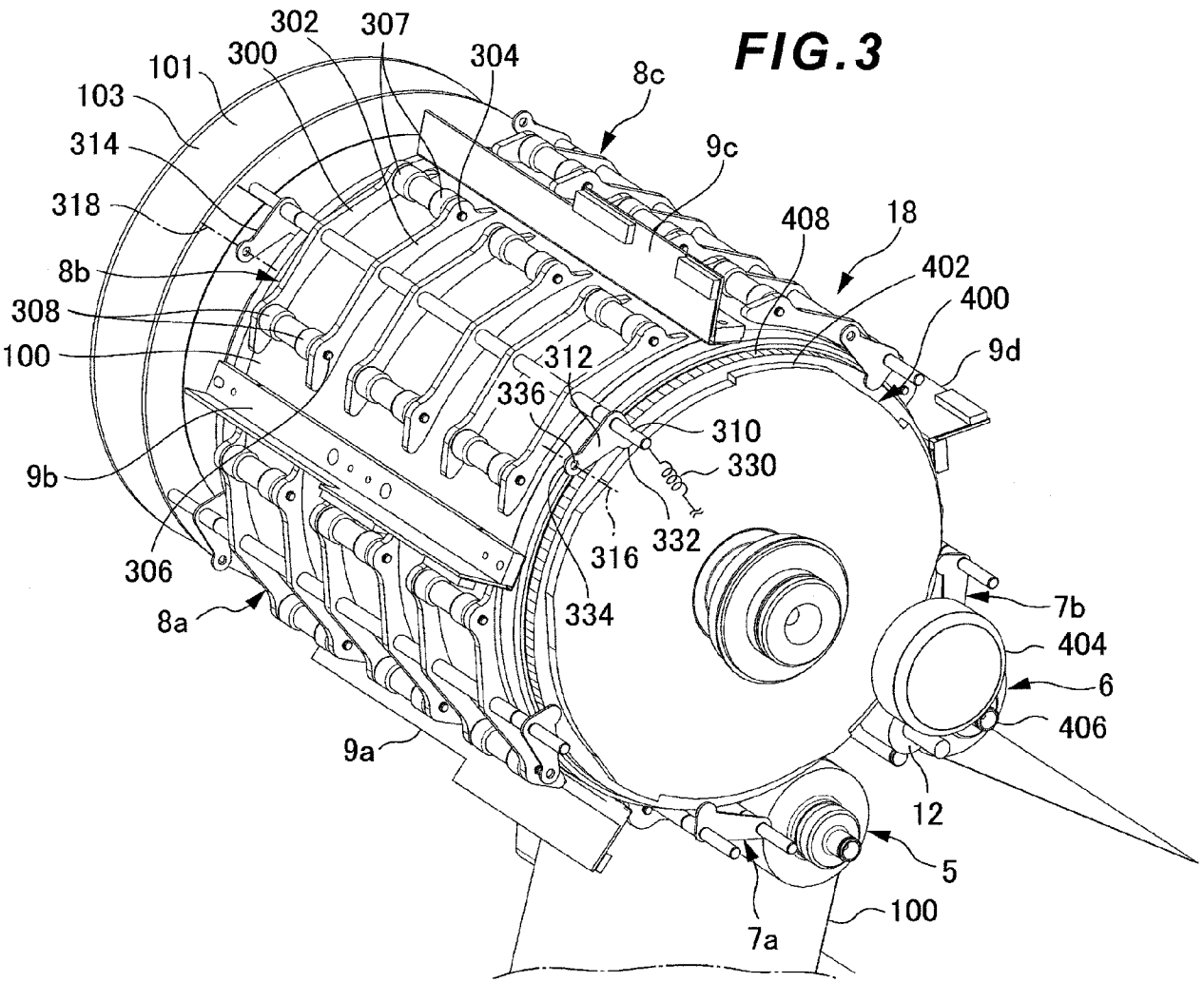
FIG. 3 is a perspective view which highlights the platen drum of the recording device.
Figure 4:
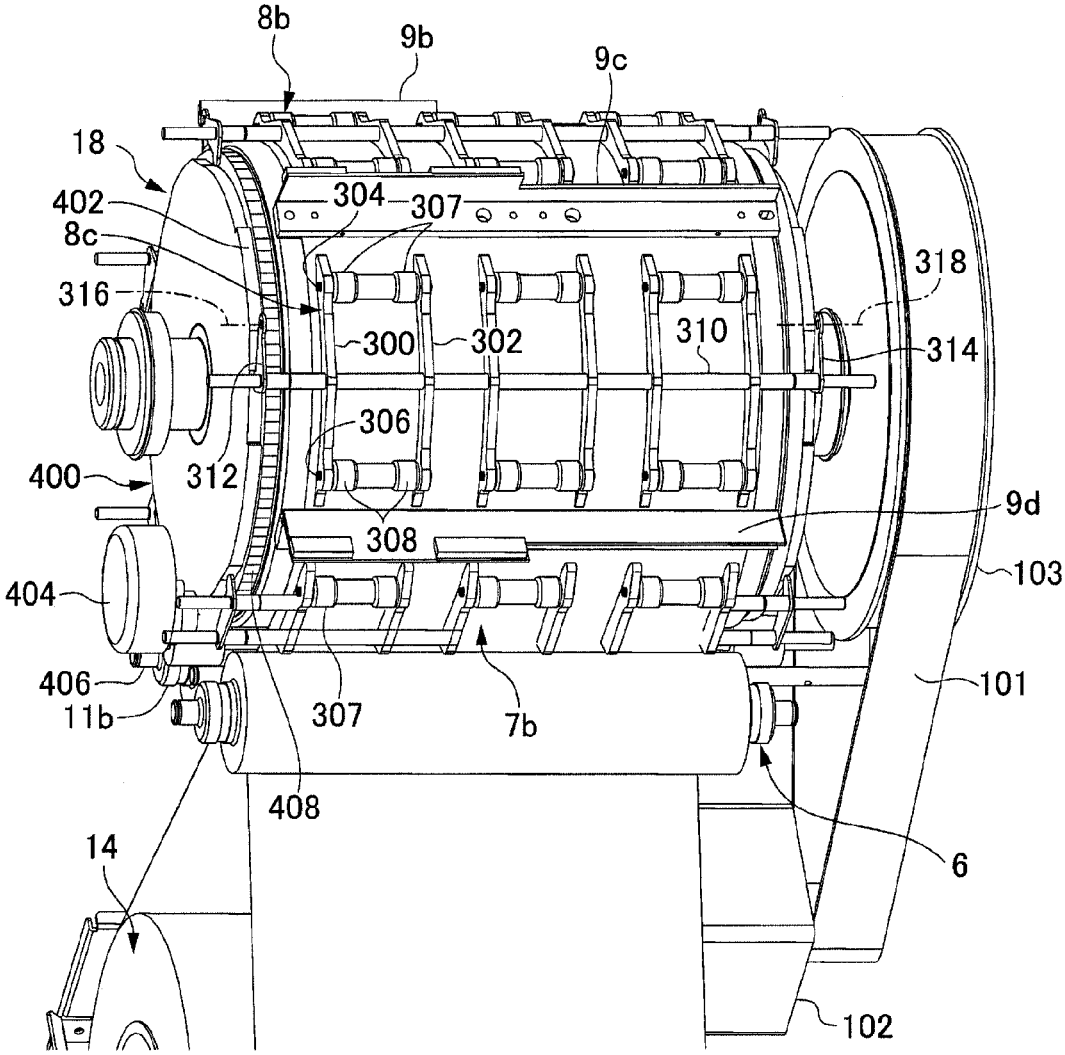
FIG. 4 is a perspective view looking down on the platen drum from a different direction.

Reference sign 103 denotes a pulley which is fixed to one end of the platen drum 18 in the rotational direction thereof, and the drive belt 101 is also wound around the pulley. This aspect is also shown in FIGS. 2 to 4. Hence, when the drive motor 102 turns, the pulley 103 is rotated by the drive belt 101 and consequently the platen drum 18 rotates.

A flexible body 18A made of rubber or the like is fixed to the circumferential surface of the platen drum 18. Predetermined friction is generated between the flexible body 18A and the recording paper 100.

When the platen drum 18 rotates, the platen drum draws the recording paper 100 under friction from the supply roller 14 and, after the stored paper is printed, conveys this paper to the cutter 13. Reference sign 15*a* denotes the conveyance direction of the recording paper, 15*b* denotes the direction of rotation of the platen drum 18, and 15*c* represents the direction in which the recording paper is delivered.

In FIGS. 1 to 3, reference sign 5 represents a first delivery roller which delivers the recording paper which has been conveyed from the supply roller 14, to the circumferential surface of the platen drum and reference signs 11*a* and 11*b* are presser rollers which press the recording paper against the first delivery roller 5. Reference sign 600 is a sensor for detecting the position of the paper (the leading edge of the paper).

Since there is a paper position sensor, the print timing of each head is determined on the basis of signals of the sensor. In reality, after the paper passes the sensor, y (yellow) ink is printed, and the timing for printing m (magenta) ink is determined from the timing for printing the y ink, whereupon the timing for printing c (cyan) ink is determined. The timing for the printing of each of the inks y, m, and c may also be determined from sensor signals.

Furthermore, reference sign 6 denotes a second delivery roller which delivers the recording paper, which has been conveyed along the circumferential surface of the platen drum and printed, to the cutter 13. Reference sign 12 denotes a presser roller which presses the recording paper against the second delivery roller.

Thermal heads used for yellow, magenta, cyan, and then for a transparent coating are arranged equidistantly along the circumferential surface of the platen drum 18. In FIGS. 1 to 5, reference sign 9*a* denotes the yellow thermal head, 9*b* denotes the magenta thermal head, 9*c* denotes the cyan thermal head, and 9*d* denotes the transparent coating thermal head.

Figure 5:
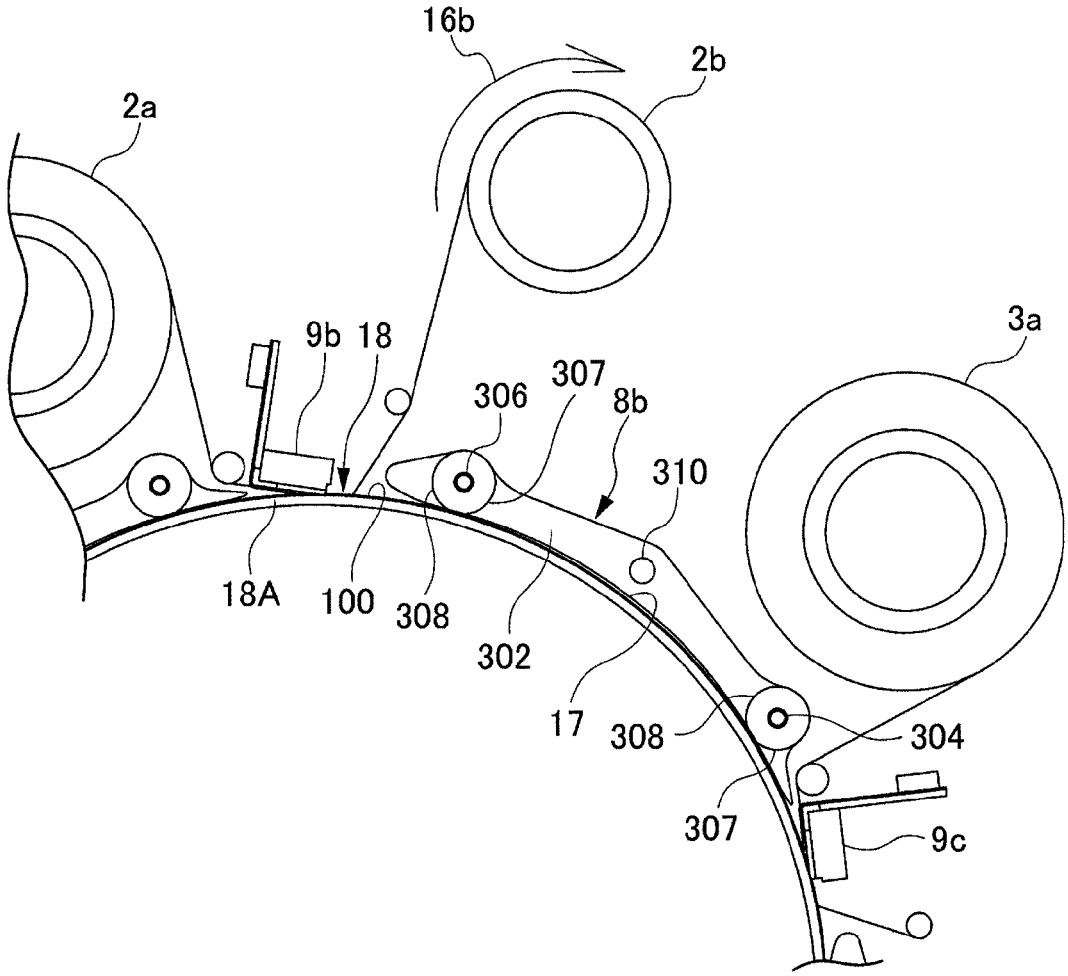
FIG. 5 is a side view of the recording device in which the biasing means are shown in an enlarged view.

The ink ribbons are supplied to each of the thermal heads. In FIGS. 1 and 5, reference sign 1*a* is a yellow ink ribbon supply roller and 1*b* denotes a yellow ink ribbon take-up roller. Similarly, reference sign 2*a* is a magenta ribbon supply roller and 2*b* is a take-up roller thereof, reference sign 3*a* is a cyan ink ribbon supply roller and reference sign 3*b* is a take-up roller thereof, and reference sign 4*a* is a coating ink ribbon supply roller and 4*b* is a take-up roller thereof. These rollers have been omitted from FIGS. 2 to 4.

The recording device comprises a well-known mechanism for moving each of the thermal heads toward and away from the platen drum 18 in the arrow direction 100A. When printing the recording paper, the recording device causes the thermal heads to abut against the conveyed recording paper and thermally transfers ink to the recording paper while continuously supplying ink ribbon between the recording paper and thermal heads.

The recording device comprises, between the thermal heads of each color, biasing means for biasing the recording paper 100 toward the flexible body 18A of the platen drum surface. Even though the recording paper is pressed against the platen drum 18 by the thermal heads (9*a*, 9*b*, 9*c*, and 9*d*), when the recording paper is conveyed, the recording paper 100 is separated from the flexible body 18A on the surface of the platen drum between two mutually adjacent thermal heads.

When the recording paper is separated from the platen drum surface, the circumferential distance (on the platen drum) between the adjacent thermal heads and the length of the recording paper between the thermal heads varies, which adversely affects the recording paper feed precision and lowers the precision with which the different inks are overlaid on the recording paper. The aforementioned biasing means are therefore provided in order to ensure that the recording paper is not separated from the platen drum between the thermal heads.

In FIGS. 1 to 5, reference sign 8*a* denotes a first biasing means which is equidistant between the yellow thermal head 9*a* and magenta thermal head 9*b*, reference sign 8*b* denotes a second biasing means which is equidistant between the magenta thermal head 9*b* and cyan thermal head 9*c*, and reference sign 8*c* denotes a third biasing means which is equidistant between the cyan thermal head 9*c* and coating thermal head 9*d*. FIG. 2 shows a side view of the biasing means. FIGS. 3 and 4 show perspective views of the biasing means. FIG. 5 shows an enlarged view of the biasing means.

The biasing means has a structure in which a pair (300, 302) of small arc-like pieces, the surface opposite the platen drum of which is shaped to follow the curvature of the platen drum circumference, lie opposite the platen drum in the axial direction thereof. Small shafts 304 and 306 which link this pair of small pieces exist at the ends of the small pieces 300 and 302 respectively in the circumferential direction. Cylindrically-shaped rolling bodies 307 are provided at the ends of the small shaft 304 beside the pair of small pieces. Rolling bodies 308 are also similarly provided on the small shaft 306. The rolling bodies are configured from rollers which smoothly rotate about the small shafts. The same effect may be provided for 300 and 302 even when the small shaft 306 and rolling body 308 are integrally formed.

The pair of small pieces 300 and 302 function as members with which a support body supporting the rolling bodies and recording paper are made to follow the platen drum. The rolling bodies 307 and 308 are supported by the support body along the circumferential direction of the platen drum 18.

Since the rotation of the platen drum 18 extends to the rolling bodies, the rolling bodies rotate while pressing the recording paper 100 surrounding the platen drum against the flexible body 18A of the platen drum surface. In the process where the recording paper 100 is conveyed between the thermal heads, separation of the recording paper from the platen drum is suppressed by the rolling bodies from the circumferential direction.

As shown in FIGS. 3 and 4, three of the aforementioned biasing means are arranged on the platen drum in a line along the rotational direction of the platen drum. The plurality of biasing means, being so arranged in a line on the platen drum, exist between two thermal heads. Reference sign 310 denotes a shaft which links the plurality of biasing means along the rotational axis direction of the platen drum. Axial holes, through which the shaft 310 passes so as to be secured, are provided in the center of the small pieces 300 and 302. The plurality of biasing means are secured in the rotational axis direction by the shaft 310. In addition, both ends of the shaft 310 are pulled in the direction of the center of the platen drum by a flexible member resembling a spring member which is represented schematically by the reference sign 330 in FIG. 3. As a result, the rolling bodies 307 and 308 bias the recording paper 100 in the direction of the platen drum center. The flexible member 330 is fixed, along the direction of the platen drum center, to a frame (not shown) to which the recording device is fixed.

Brackets 312 and 314, for fixing the group of biasing members linked to one another by the shaft to the frame, are provided at both ends of the shaft 310 respectively. These brackets comprise a bulged portion 332 which is shaped with a bulge at one end. The aforementioned shafts 310 are inserted into the bulged portion. The opposite end of the bulging part has a tapered base end 334 into which a short shaft 316, protruding from the frame in the rotational axis direction, is inserted into a circular hole 336 in the base end 334 (FIGS. 3 and 4). As a result, one end of the shaft is fixed to the frame on the same side as the shaft. The other end of the shaft 310 is similarly fixed to the frame on this side.

In FIGS. 3 and 4, the reference sign 314 denotes a bracket on the other end of the shaft 310 and reference sign 318 denotes a short shaft which protrudes from the frame on this side toward the biasing means. As a result, the other end of the shaft is also fixed to the frame. Hence, as a result of the two ends of the shaft 310 being fixed to the frame, the plurality of biasing means are fixed to the frame while engaging with the platen drum.

The small pieces 300 and 302 of the biasing means engage with the platen drum 18 via a minimum clearance 17 as shown in FIG. 5. As a result, even if the recording paper 100 is separated from the platen drum between the rolling bodies (307, 308) at both ends of the biasing means, the small pieces facing the recording paper via a minimum clearance interfere with the rise of the recording paper, thereby keeping separation of the recording paper from the platen drum to a minimum.

The level of clearance 17 permitted is determined by errors in feeding the recording paper (variations in the feed amount) between the thermal heads. For example, if zero feed error is desired, the clearance would then be zero, but in reality since the paper must slide, clearance is preferably provided. However, because, when this clearance is large, the recording paper separates from the drum surface, feed errors are generated due to circumferential errors and so on.

Figure 6:
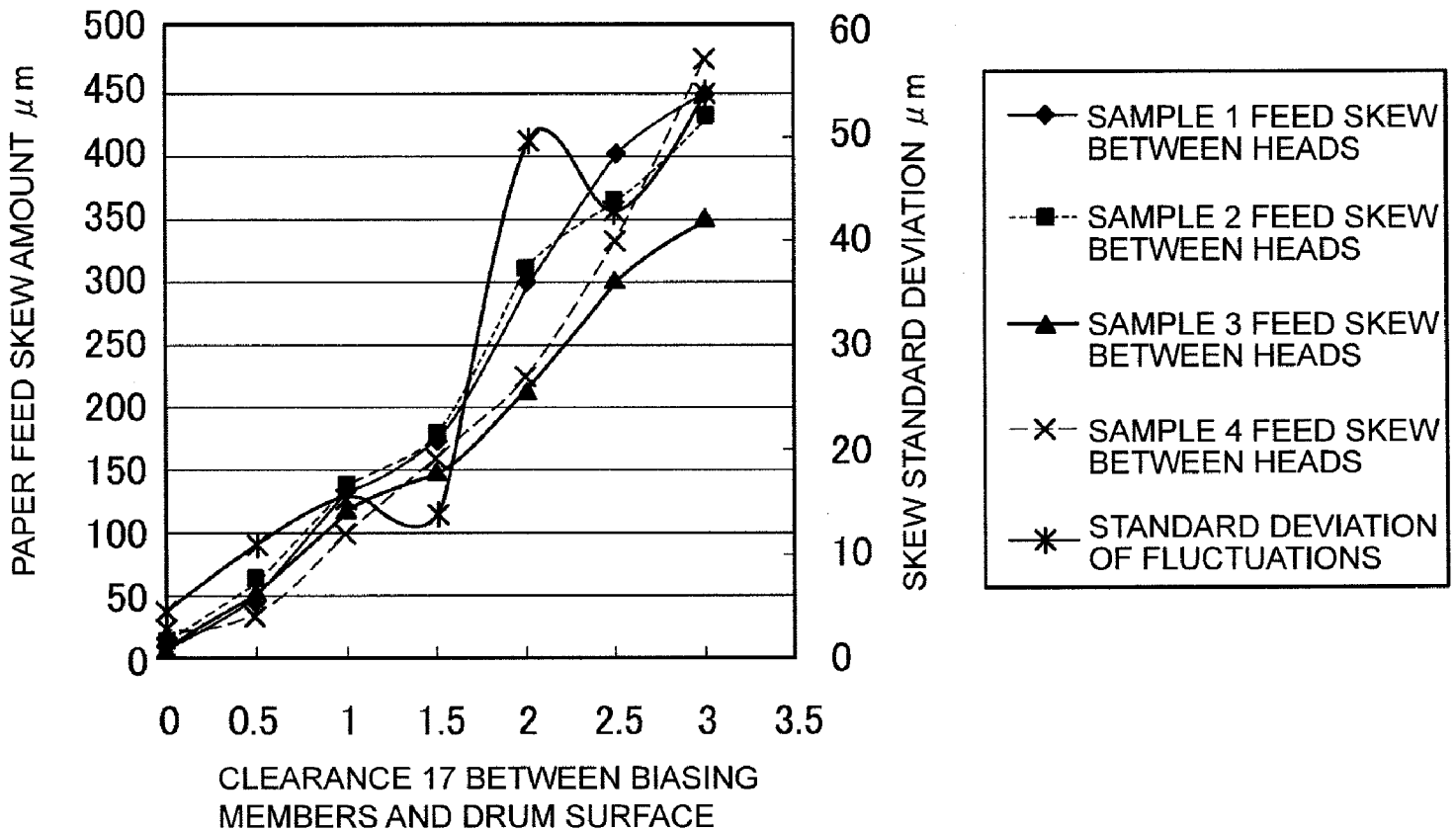
FIG. 6 shows measurement results relating to the effect of clearance between the biasing means and drum surface on the precision with which the medium is fed.

Furthermore, when a support body which is a guide for the medium is large and spaced apart from the platen drum, the paper feed precision tends to deteriorate in particular as a result of the leading edge of the recording paper tracing out a large radius from the circumference of the platen drum and generating a feed skew, and therefore the rollers 307 and 308, which are conveyance members, and the support body 302 are integrated and disposed at the circumference of the drum. However, the smaller the clearance between the support body and drum, the better. In order to obtain a 300-DPI print quality, the permitted feed error of the storage medium is at most eighty-four microns, which is equivalent to one per dot, but if the feed error is always constant and the print timing is changed with this error serving as a parameter, the overlay of the dots printed by the heads is then constant. As a result of verifying the trend in clearance, feed error, and variations as they apply to this mechanism, under the verification conditions it can be seen that, as shown in FIG. 6, the feed precision suddenly becomes unstable from the point where the clearance of the drum-side surface of the biasing member from the drum surface is 1.5 millimeters. If the error tolerance is $3\Sigma$ and 84 microns÷3 is the value of the standard deviation and approximately 28 microns, the clearance is 1.5 millimeters or less according to FIG. 6. In order to resolve the constant feed error with no variations, the energization and printing timing of each thermal head is variably adjusted. For example, if the clearance of the biasing members is one millimeter, there is a shift in the energization timing equivalent to 100 microns between the thermal heads. If the clearance is 0.5 millimeter, there is a shift in the energization timing equivalent to 50 microns. These settings are determined by measuring the actual printed displacement or determined from the design clearance of the biasing member. As mentioned earlier, the smaller the clearance the better in the minimum range required to allow the medium to be conveyed smoothly and in a range which allows medium feed errors to be amended by correcting the energization and printing timing, and is set as small as possible, for example, in the range 0 to 5.0 mm, preferably no more than 3.0 mm, and more preferably no more than 1.5 mm.

Furthermore, although pressing the arc-like small pieces (300, 302) against the platen drum with no clearance and without using the rolling bodies has also been considered, when the friction between the biasing means and the conveyed recording paper 100 overcomes the friction between the recording paper 100 and flexible body 18A, the feed precision of the recording paper 100 will likely deteriorate.

Furthermore, even when this does not occur, the small pieces will likely scratch the recording paper. On the other hand, no such problem arises when the rolling bodies press against the recording paper. However, the frictional coefficient between the rotation of the rolling bodies and platen drum and the recording paper that moves in step with the platen drum must be smaller than the frictional coefficient between the recording paper and the flexible body of the platen drum surface. The rolling bodies have been described as being at both ends of the biasing means in the circumferential direction but the configuration is not limited to this arrangement. The biasing means may also comprise rolling bodies. Note that in FIGS. 1 and 5, reference signs 16*a*, 16*b*, and 16*c* denote the rotational directions of the ink ribbon take-up rollers respectively.

The recording device winds the recording paper 100 around the platen drum 18 and conveys the recording paper under the friction between the recording paper 100 and the flexible body 18A of the surface of the platen drum. As a result, the conveyance of the recording paper is realized by one conveyance system called the platen drum and hence the problem where the recording paper feed precision drops when the recording paper is fed by a plurality of conveyance systems, as is the case conventionally, does not arise. In addition, the problem where the recording paper is stretched or buckles does not occur.

The recording device comprises biasing means (7*a*, 7*b*) with the same configuration (FIGS. 1, 3, and 4) on both the upstream side close to the yellow thermal head 7*a* (along the conveyance direction of the recording paper) and the downstream side close to the coating thermal head 7*d*, thereby improving the contact between the recording paper 100 and the platen drum 18. This configuration improves the precision with which the recording paper is fed to the thermal head 9*a* directly after the recording paper is supplied to the platen drum and the precision with which the recording paper is delivered to the thermal head 9*d* directly before the recording paper is ejected from the platen drum.

Note that, as shown in FIG. 4, the rolling bodies of the biasing means are provided only on the thermal head side and not on both sides of the small pieces. This is because there is no interference with the feeding of the recording paper onto the platen drum or subsequent delivery of the recording paper from the platen drum.

In addition, the recording device comprises a drive mechanism which moves the biasing means described hereinabove toward and away from the platen drum. This embodiment uses a cam structure as the mechanism. This structure will be explained hereinbelow.

As shown in FIGS. 1 to 4, a circular body 400 with a cam structure formed on the outer circumference thereof is provided on the opposite side of the platen drum 18 from the pulley 103. A plurality of large-diameter portions 402, which correspond to the cam structure, are formed equidistantly on the circumference of the circular body in the circumferential direction. The reference sign 404 is a motor for rotating the circular body. This motor rotates the gear 406. This gear meshes with a groove in the outer edge of the rotor 408 fixed to the circular body 400. When the motor 404 rotates, the gear 406 rotates, and as a result of the rotation of this gear, the rotor 408 rotates. As a result of the rotation of this rotor, the circular body rotates in a clockwise- or counterclockwise direction (412 in FIG. 2). When the circular body 400 rotates, the large-diameter portions 402 abut against the bulged portion 332 of the bracket 312.

Thereupon, the bracket pivots about the axis of the base end 334 and the bulged portion 332 of the bracket 312 rises against the elastic force of the flexible member 330 (FIG. 3) in the direction of separation from the platen drum 18. As a result, while printing is not performed on the recording paper, the pressing force from the surface of the platen drum onto the elastic body 18A due to the rolling bodies 307 and 308 is released.

However, when the recording device prints on the recording paper, the circular body 400 rotates and the abutment between the large-diameter portions 402 and the protuberances 332 is canceled. As a result, the end of the shaft 310 is pulled by the flexible member 330 and the bracket 312 rotates toward the center of the platen drum, and the rolling bodies 307 and 308 pressure-contact the recording paper 100.

An operation will be explained next in which, when the rotating core (500 in FIG. 5) of the platen drum 18 is disposed eccentrically from the dead center of the platen drum 18, the recording device performs processing to correct the rotation of the platen drum. Supposing that the angular velocity of the platen drum is constant, the actual circumferential velocity (V') at a given point on the surface of the platen drum varies as follows.

$$(R-(\Delta R\times\pi\times\sin\theta))/R\times V=V'$$

R: radius at dead center of platen drum

ΔR: eccentricity amount

θ: rotational angle of platen drum

V: circumferential velocity if there is no eccentricity

Figure 7:
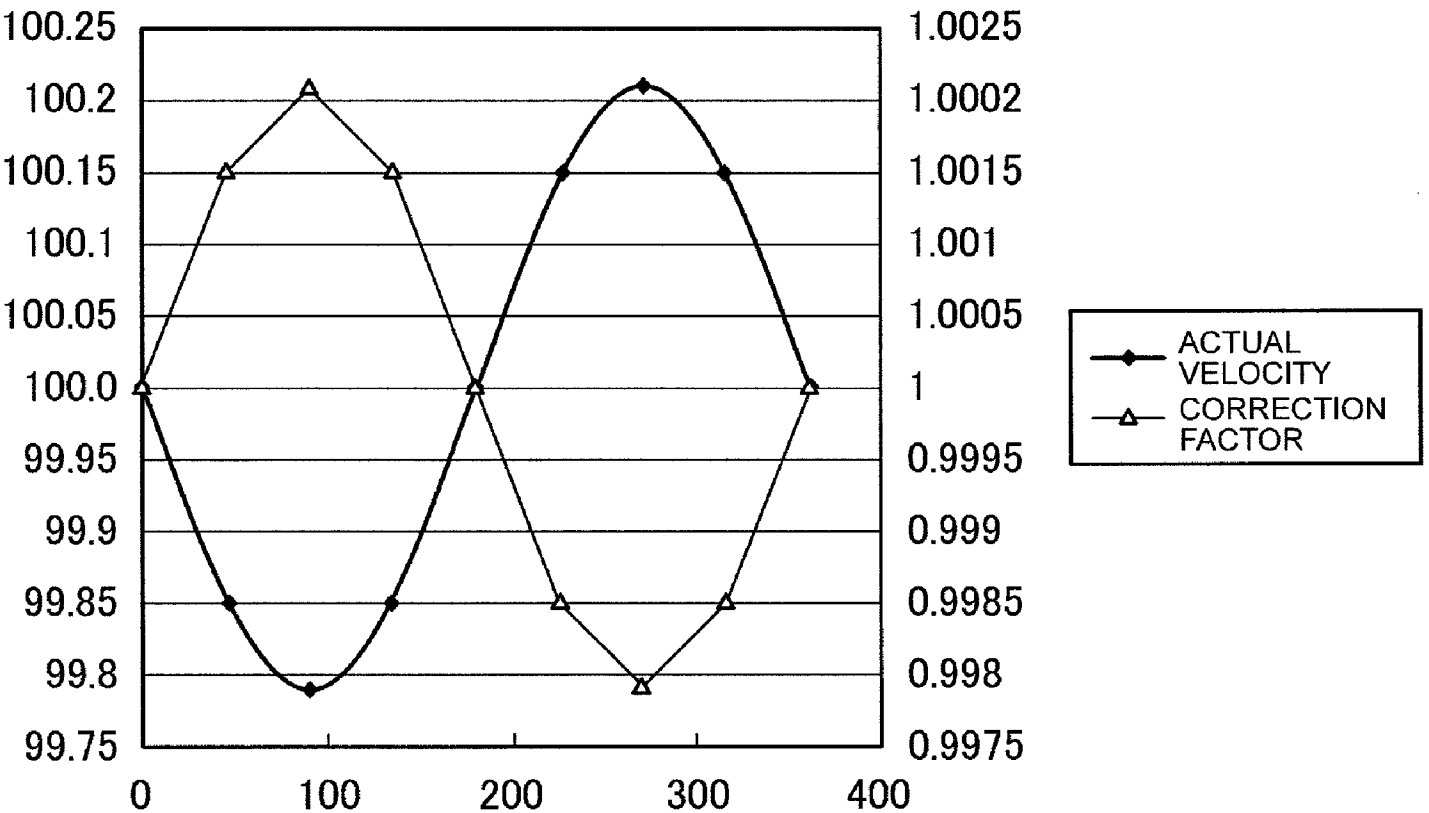
FIG. 7 shows a characteristic diagram serving to illustrate a correction formula for drum eccentricity.

Therefore, if the eccentricity is measured beforehand, the calculation formula, in which the circumferential velocity of the platen drum is out of phase by 180 degrees as a result of being changed by the rotational angle, is a correction formula, that is, if the control circuit of the drive device 102 causes the motor of the drive device to rotate the platen drum 18 via the drive belt 101 so that V'/V×motor pulses (motor speed), the circumferential velocity (V) can be made constant even when the platen drum is eccentric (see FIG. 7).

As per the aforementioned recording device, as long as the medium can be accurately conveyed to the thermal heads without feed errors, the position of the thermal heads disposed on the circumference of the platen drum is dimensionally fixed, and therefore if the recording paper is printed at regular time intervals, each print can be overlaid in synchronized fashion.

Furthermore, even when the platen drum is eccentric, as a result of measuring fluctuations in the circumferential velocity of the drum and the drive unit compensating for the eccentricity error and rotating the platen drum to counter the velocity fluctuations, the circumferential velocity of the platen drum is constant and recording paper feed errors can be eliminated. There is therefore no need for the recording device to acquire recording paper position information or perform feedback control relating to the feeding by the recording device.

According to the present invention, precise color overlay in a thermal transfer printer with three or more heads is made possible by eliminating recording paper conveyance errors.

What is claimed is:

1. A thermal transfer recording device, comprising:

a platen drum which comprises a flexible body on a circumferential surface thereof;

first means for rotationally driving the platen drum;

at least three thermal heads arranged sequentially along the circumferential surface of the platen drum;

second means for supplying a medium to the platen drum;

third means for supplying ink ribbon between each of the thermal heads and the medium;

fourth means, provided close to the circumferential surface of the platen drum between the plurality of thermal heads, for biasing the medium toward the flexible body; and fifth means for controlling print cycle timings, for printing the medium, of each of the plurality of thermal heads, wherein the platen drum sequentially conveys the medium to the plurality of thermal heads in accordance with the rotation of the platen drum as a result of friction acting between the flexible body and the medium which is pressed by the plurality of thermal heads onto the flexible body, wherein the fourth means either contacts the medium to prevent conveyance of the medium being affected or at least close to the medium via a gap which does not exceed an inevitable clearance, wherein the fourth means comprises a first member which presses the medium toward the flexible body while making rolling contact or sliding contact with the medium which is conveyed by the flexible body, and wherein a coefficient of friction between the first member and the medium is smaller than a coefficient of friction between the medium and the flexible body.

2. A thermal transfer recording device, comprising:

a platen drum which comprises a flexible body on a circumferential surface thereof;

first means for rotationally driving the platen drum;

at least three thermal heads arranged sequentially along the circumferential surface of the platen drum;

second means for supplying a medium to the platen drum;

third means for supplying ink ribbon between each of the thermal heads and the medium;

fourth means, provided close to the circumferential surface of the platen drum between the plurality of thermal heads, for biasing the medium toward the flexible body; and fifth means for controlling print cycle timings, for printing the medium, of each of the plurality of thermal heads, wherein the platen drum sequentially conveys the medium to the plurality of thermal heads in accordance with the rotation of the platen drum as a result of friction acting between the flexible body and the medium which is pressed by the plurality of thermal heads onto the flexible body, wherein eccentricity, which is the difference between the dead center of the platen drum and the rotational center, is measured beforehand, and wherein the first means is controlled to compensate for rotational variations of the platen drum based on the eccentricity so that a surface velocity of the platen drum is constant relative to each of the plurality of thermal heads.

* * * * *